US009487913B2

(12) United States Patent
Urbini

(10) Patent No.: US 9,487,913 B2
(45) Date of Patent: Nov. 8, 2016

(54) METHOD FOR THE ARTIFICIAL AGING OF FABRICS AND READY-MADE GARMENTS

(71) Applicant: SOKO CHIMICA SRL, Florence (IT)

(72) Inventor: Matteo Alfonso Urbini, Florence (IT)

(73) Assignee: SOKO CHIMICA SRL, Florence (IT)

( * ) Notice: Subject to any disclaimer, the term of this patent is extended or adjusted under 35 U.S.C. 154(b) by 0 days.

(21) Appl. No.: 14/404,454

(22) PCT Filed: Jun. 10, 2013

(86) PCT No.: PCT/IB2013/054741

§ 371 (c)(1),
(2) Date: Nov. 27, 2014

(87) PCT Pub. No.: WO2013/186687

PCT Pub. Date: Dec. 19, 2013

(65) Prior Publication Data

US 2015/0111284 A1 Apr. 23, 2015

(30) Foreign Application Priority Data

Jun. 11, 2012 (IT) ..... FI2012A0116

(51) Int. Cl.

| | |
|---|---|
| ***D06M 16/00*** | (2006.01) |
| ***D06M 11/34*** | (2006.01) |
| ***D06L 3/04*** | (2006.01) |
| ***D06M 23/06*** | (2006.01) |
| ***D06B 11/00*** | (2006.01) |

(52) U.S. Cl.

CPC ..... *D06M 16/003* (2013.01); *D06B 11/0096* (2013.01); *D06L 3/04* (2013.01); *D06M 11/34* (2013.01); *D06M 23/06* (2013.01)

(58) Field of Classification Search

CPC ..... D06M 16/003

See application file for complete search history.

(56) References Cited

U.S. PATENT DOCUMENTS

| | | | | |
|---|---|---|---|---|
| 4,740,213 | A | 4/1988 | Ricci | |
| 4,912,056 | A | 3/1990 | Olson | |
| 6,571,585 | B1 * | 6/2003 | Wasinger ..... | D06B 11/0096 68/13 R |

FOREIGN PATENT DOCUMENTS

| | | | |
|---|---|---|---|
| CN | 1912224 | A | 2/2007 |
| CN | 101457477 | A | 6/2009 |
| IT | 1215001 | B | 1/1990 |
| WO | WO 0157173 | A1 | 8/2001 |

OTHER PUBLICATIONS

Machine translation of WO2001057173A1, pp. 1-10.*
Database WPI Week 200806.
Thomson Scientalc, London, GB; AN 2008-A79891.
Feb. 14, 2007 abstract.
WO 01/57173 A1 (Bayer AG [DE]; Franke Guenter [DE]; Vogt Uwe [DE]: Schindler Markus [D]) Aug. 9, 20001 (Aug. 9, 2001) the whole document.
Database WPI Week 200951.
Thomson Scientific, London, GB; AN 2009-K99980.
XP002692904, & CN 101 457 477 A (Dalian Anming Hongfeng Printing & Dyeing) Jun. 17, 2009 abstract.

* cited by examiner

*Primary Examiner* — Bin Shen
(74) *Attorney, Agent, or Firm* — John Alumit

(57) ABSTRACT

A method for the artificial aging of fabrics by applying an enzyme compound without using an aqueous bath.

20 Claims, 5 Drawing Sheets

Fig. 0001
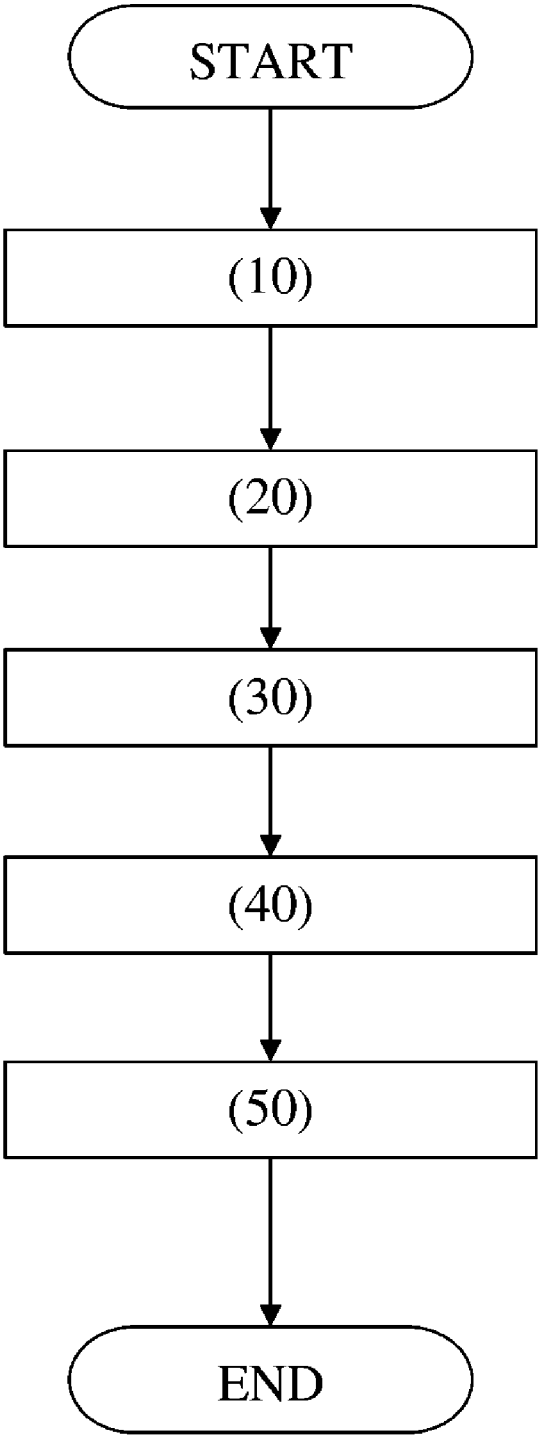

Fig. 0002
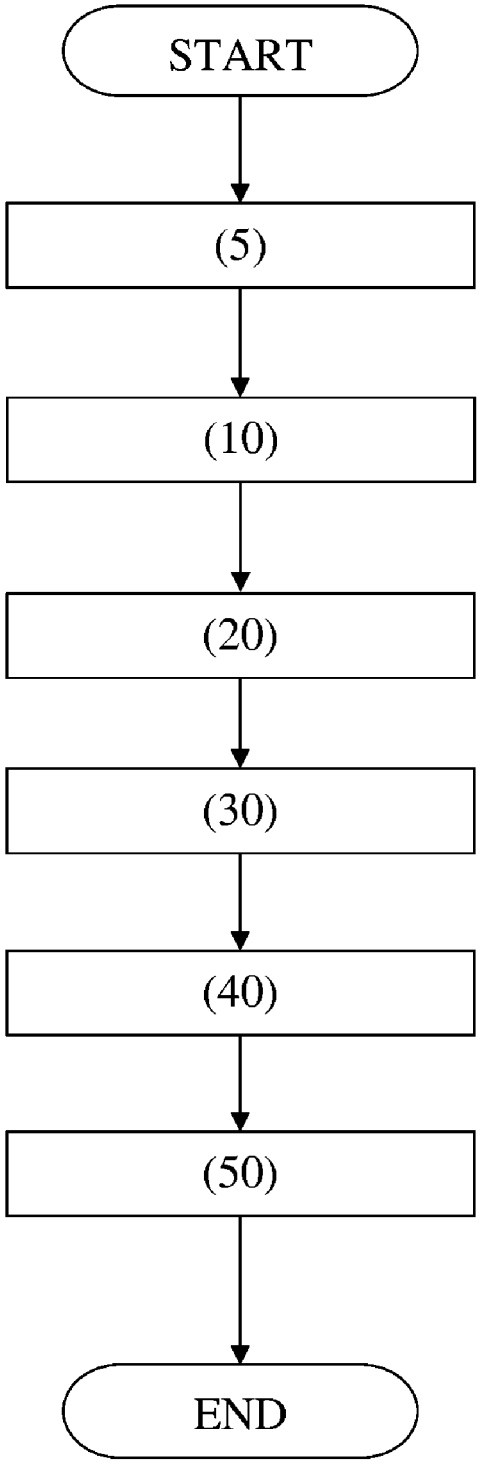

Fig. 0003
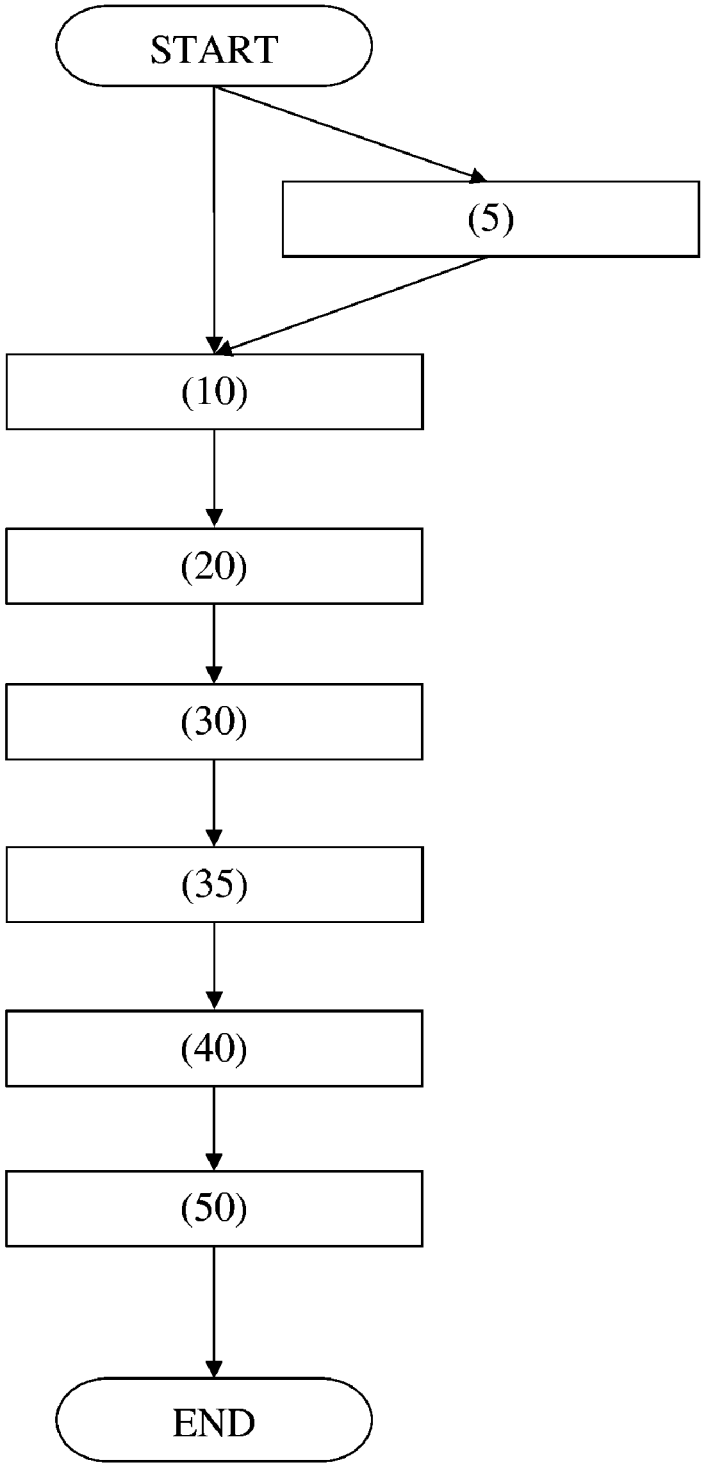

Fig. 0004
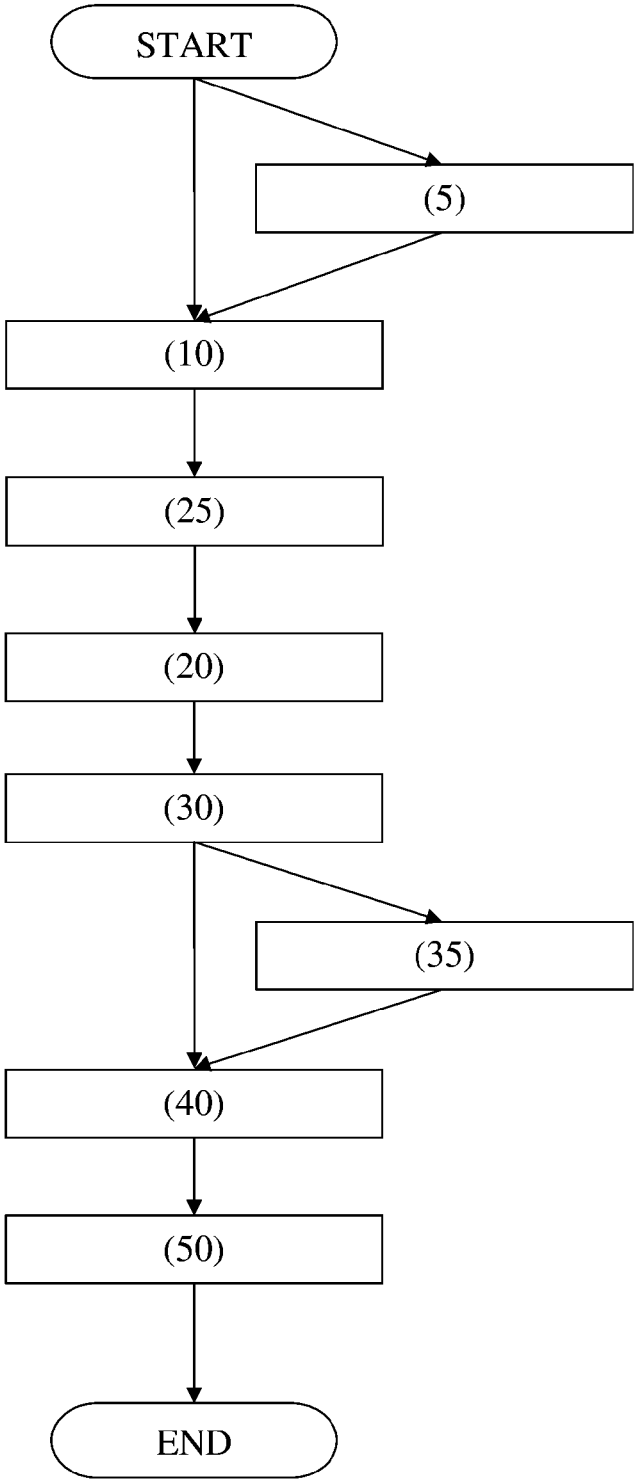

Fig. 0005
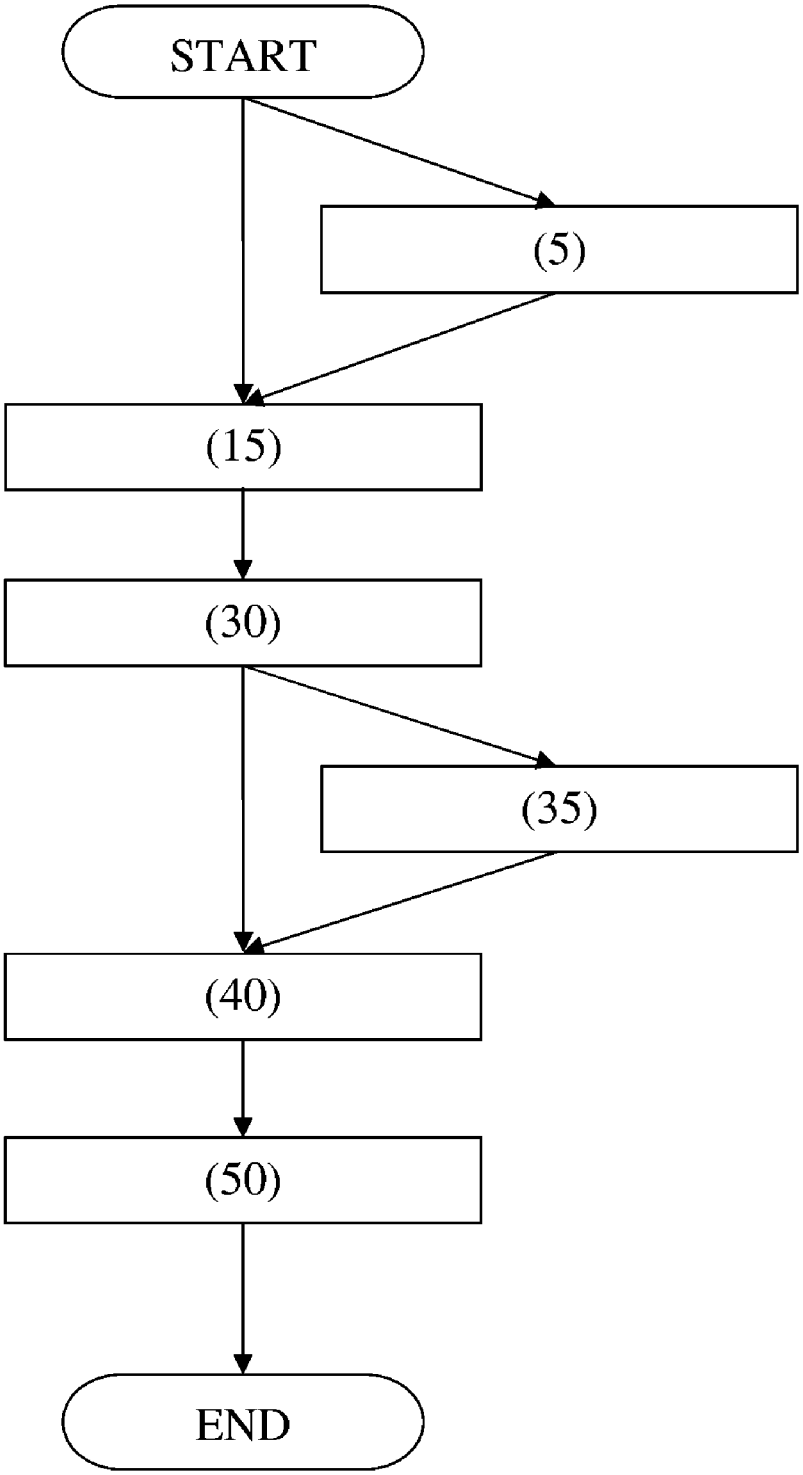

METHOD FOR THE ARTIFICIAL AGING OF FABRICS AND READY-MADE GARMENTS

CROSS-REFERENCE TO RELATED APPLICATION

This application is a national stage patent application arising from PCT/IB2013/054741 filed on Jun. 10, 2013, and referenced in WIPO Publication No. WO2013/186687. The earliest priority date claimed is Jun. 11, 2012.

FEDERALLY SPONSORED RESEARCH

None

SEQUENCE LISTING OR PROGRAM

None

DESCRIPTION

1. Technical Field

The present invention pertains to the fabrics industry, for example, cotton or denim, to be applied in the garment's treatment stage. Specifically, the treatments considered are those aiming at obtaining an artificial aging effect, commonly referred to as "stone wash" treatments in reference to the stone washing system used.

2. Prior Art

In the fabrics treatment industry, methods have long been known for artificially aging brand new fabrics in order to give them a more or less worn-out appearance and to make the cloths lighter and looser.

The first treatments of this type were often based on the combined action of an aqueous bath and abrasive stones which, by rolling them together with fabric in a washing machines' rotating drum, resulted in artificial aging of the fabric. Instead of abrasive stones, typically pumice, or other small-size solid bodies made of abrasive materials, might be used.

In order to make these treatments more effective, bleaching agents including, for instance, sodium hypochlorite, were often added in the bath.

In the procedures described above, the abrasive material, oweing to the bath, exercises its action on both the right side and the reverse side of the garment.

Treatments were later developed, in which the action of small balls of solid material were integrated or even completely replaced by enzymatic products that impregnate the textile substrate, this way performing their action on the complete fabric; examples of such a treatment are described in PTL 0001: U.S. Pat. No. 4,912,056 A (ECOLAB INC [US]). 1990 Mar. 27. or in PTL 0002: WO WO 01/57173 A (BAYER AG [DE]). 2001 Aug. 9.

It is well known that enzymes are highly temperature sensitive. Amilase withstands a maximum temperature of 110° C., Cellulase 90° C. and Laccase 90° C. As a consequence, during their initial application, steam could not be used in treatments involving enzymes.

The action of enzymes depends on size, starches present in raw fabric, and the cellulose fiber of the yarn or on the Indigo colour used in Denim fabrics.

This type of treatment is commonly made in an aqueous bath and subsequently needs a rinsing to remove any traces of enzyme residues.

Usually, a better chemical application can be obtained by passing the fabric through a pad.

It is worth emphasizing that the use of an aqueous bath presents a number of drawbacks, for instance, the need for draining significant quantities of baths contaminated by enzymes, hence dangerous for the environment.

For these reasons and others, dry artificial aging treatments were developed, one of which is described in PTL 0003: IT 1215001 B (CANDIDA S R L [IT]). 1990 Jan. 31, in which porous particles were imbibed with a bleaching agent and subsequently put in contact with garments to be aged, without using any aqueous bath.

OBJECTS AND BRIEF DESCRIPTION OF THE INVENTION

As already mentioned before, treatments using an aqueous bath present a number of major drawbacks, which lead to the pursuit of dry solutions, in which "dry" means "soaking without dipping"

In this patent application, "fabric" is the substrate where enzymes act and "garments" are the objects over which the treatment is applied.

The objective of the present invention is to provide a method to artificially age a fabric or more specifically, garments made of fabric, especially made of vegetal fabric, including cotton or denim, while avoiding the drawbacks derived from the need to use an aqueous bath for treatment, and reducing the use of water baths to solely rinsing steps, with a consequent drastic reduction in the quantity of water used.

In a standard treatment, using water baths to apply the enzymes, the used quantity of water is roughly four times the quantity of water required in pursuing the method hereby described.

This objective is achieved by applying an enzyme compound, mixed with water and possibly with other chemical compounds including, for instance, surfactants, by atomization, and by subsequently activating said enzyme compound in a humidity-, time-, and temperature-controlled environment, without using a traditional application bath.

In the present patent application, said controlled environment has been referred to as an "industrial dryer;" however it should be noted that such a choice is made because an industrial dryer is the most popular device among those which can be used to implement the method according to the present patent application. To be exact, it is advisable to reduce or even eliminate the removal of the humidity step usually adopted in industrial dryers, in order to hold a high degree of humidity inside them. Should it not be possible to reduce or eliminate such a removal of humidity, it would be advisable to add water, either alone or mixed with said solution.

A further advantage of the present invention is that a good cleaning of the textile fiber is possible considering contamination derived from the dye, which otherwise, when using an aqueous treatment bath, might disperse.

BRIEF DESCRIPTION OF DRAWINGS

FIG. 1 shows a flow chart indicating the basic steps of the method according to the present patent application, as claimed in the main claim:

Application (10);
Activation (20);
First Deactivation (30);
Cleaning and Last Deactivation (40);
Drying (50).

FIG. 2 shows a flow chart indicating the basic steps of the method according to the present patent application, as claimed in claim 2:

Preparation (5);
Application (10);
Activation (20);
First Deactivation (30);
Cleaning and Last Deactivation (40);
Drying (50).

FIG. 3 shows a flow chart indicating the basic steps of the method according to the present patent application, as claimed in claim 3:

Preparation (5), if any;
Application (10);
Activation (20);
First Deactivation (30);
Ozone Cleaning and Bleaching (35);
Cleaning and Last Deactivation (40);
Drying (50).

FIG. 4 shows a flow chart indicating the basic steps of the method according to the present patent application, as claimed in claim 4:

Preparation (5), if any;
Application (10);
Slight Centrifugation (25);
Activation (20);
First Deactivation (30);
Followed by the following steps:
Cleaning and Last Deactivation (40);
Drying (50).
Or by the following steps:
Ozone Cleaning and Bleaching (35);
Cleaning and Last Deactivation (40);
Drying (50).

FIG. 5 shows a flow chart indicating the basic steps of the method according to the present patent application, as claimed in claim 5.

Preparation (5), if any;
Application and Activation (15);
First Deactivation (30);
Followed by the following steps:
Cleaning and Last Deactivation (40);
Drying (50).
Or by the following steps:
Ozone Cleaning and Bleaching (35);
Cleaning and Last Deactivation (40);
Drying (50).

DETAILED DESCRIPTION OF AN EMBODIMENT OF THE INVENTION

The use of a mixture of enzyme compounds and water (hereafter also referred to as "mixture") constitutes the basis of the method for artificially aging fabric- or textile-made garments according to the present invention.

The enzyme compounds to be used to prepare the mixture are one or more of the following: Amylase, Cellulase, Laccase.

Note that by "compounds" we mean both the enzyme protein and any other additional components used for its preservation, stabilization, dilution, activation, as well as any other adjuvant.

Also, the enzyme compounds as mentioned above shall be activated by means of heat, and the activation temperature varies as a function of type of enzyme used. In general, it shall be as low as possible, depending on the performances of the mixture, in order to better preserve the degree of humidity.

For reference only, according to the characteristics of the enzyme products presently available on the market, the optimum temperature is preferably on the order of 45-50° C. for mixtures containing Amylase and Cellulase, whereas a temperature in the order of 55-60° C. is recommended whenever Laccase is used.

Experts in this sector clearly know that Laccase is only used to treat denim fabric, because it is only effective on indigo. It creates a brightening of the dye. Consequently the use of this specific enzyme compound is advantageous both to artificially age the fabric and to simultaneously get a cleaning of the white weft of the denim, and a consequent change in the fabric tone.

In its basic sequence, the method according to the present invention fundamentally comprises the following operating steps.

Application (10)

Atomize a mixture of enzyme compounds and water on the still raw fabric, by spraying them until a textile garment featuring a high degree of humidity is obtained;

Activation (20)

Make the fabric turn in an industrial dryer for 40-60 minutes at the activation temperature specified for the enzyme compound used.

According to a preferred solution, which uses Cellulase or Amylase, such an activation might be made at a temperature in the range of 45 to 50° C.; whenever Laccase is used, such a temperature shall be in the range of 55 to 60° C., as an indication.

In this operating step, a rubbing mechanical action shall also take place.

First Deactivation (30)

At the end of the cycle, raise the temperature up to at least 90° C. for approximately 20 minutes in order to deactivate the enzyme.

Cleaning and Last Deactivation (40)

Perform at least one thorough rinse in order to remove any kinds of drosses, residues or other substances present in the fabric.

Drying (50)

Dry according to known methods.

In normal conditions, it is often advisable to have the first Application step (10) preceded by a Preparation step (5), consisting of preparing the fabric of the ready-made garments, by one or several preliminary operations including, for instance, manual abrasion, mechanical abrasion, laser abrasion, sandpapering, wearing, emery-polishing, and sandblasting.

Advantageously, according to a preferred embodiment of this invention, in order to improve the visual appearance of artificial aging, and to further deactivate the enzyme, said First Deactivation step (30) might be followed by a Ozone Cleaning and Bleaching step (35) consisting of making the treated fabric pass through an ozone machine.

Such an ozone treatment might take place under operating conditions that best fit such an application and, considering how much the application means differ from each other, it is not possible to previously determine the standard parameters to optimize the ozone action.

Said Ozone Cleaning and Bleaching step (35), even though not mandatory, is recommended in order to better deactivate the enzyme compound and to get a lighter tone in colour, which consequently appear visibly more aged.

To speed up execution of the method, according to the present patent application faster, the Application step (10) and the Activation step (20) can be combined by spraying the mixture of enzymes and water directly inside the dryer. This reduces the process costs, because the application is no longer discontinuous and is simultaneously more homogeneous. In this case, the process includes a first, more abundant dose of mixture, with subsequent additions of water only to compensate for humidity loss, or with subsequent additions of mixture.

In order to enhance the fabric's aging effect and to increase its loosing appearance, small rubber and/or plastic balls or other small abrasive bodies, might be advantageously added inside the industrial dryer.

In this operating step, the introduction of the enzyme mixture and water might be modulated in time, by introducing it in several steps. In this way, the results obtained would be more extended and regular in time, hence more effective.

Mixture dilution, quantity of mixture to apply, and stay time during the activation step are variable parameters and are a function of the type and characteristics of the fabric to be treated and of the effect to be obtained.

To implement the present invention, experts in this sector should always consider that the fabric would be initially very humid, so as to retain such a condition as long as possible during the Activation step (20).

A constant degree of humidity, i.e. the constant quantity of mixture present on all the fabric treated, is important to assure a homogeneous and uniform action. For this purpose, appropriate precautions should be taken depending on the whole production cycle.

A slight centrifugation might even be adopted before Activation (20), as well as a refilling of mixture during activation. Even though residual humidity is important, it should never be too high. Hence, in no case should liquid drip from the fabric.

In the various steps following the mixture application step, timing issues are, in principle, very important to ensure a homogeneous treatment; in particular, one should consider that after being applied, the product may activate, and also lose its effectiveness. It follows that any dead or irregular times during the production cycle should be minimized, or in any case be kept constant, in order to preserve a more homogeneous result and to avoid ineffectiveness or loss of resistance in the fabric. A user should, in any case, monitor such conditions, along with product deactivation, and consider that the operating times should be carefully monitored, at least until rinsing.

Since the present method is based on the application of an enzyme product, the importance of removing the product from the fabric after its treatment, should be emphasized, as well as the need for strictly adopting necessary precautions for industrial health.

In general, enzyme deactivation factors include: a temperature greater than 90° C., abundant rinsings, and alkaline washing. It may not be the case that only one of these would suffice.

What is claimed:

1. A method for artificially aging textile garments, especially cotton or denim garments, comprising the steps of:

a) preparing a mixture of enzyme compounds and water;

b) humidifying a fabric garment with said mixture;

c) placing the fabric garment in an industrial dryer and operating the industrial dryer for at least forty minutes at an activation temperature of the enzyme compound;

d) raising the temperature to at least ninety degrees Celsius for at least ten minutes in order to deactivate the enzyme;

e) rinsing the fabric garment until drosses, and mixture residues are not present in the fabric garment; and f) drying the fabric garment;

wherein the step of humidifying a garment is done by spraying said mixture over it.

2. The method of claim 1 further comprising the step of preparing the fabric garment prior to the humidifying step by an action selected from the group consisting of manual abrasion, mechanical abrasion, laser abrasion, sandpapering, wearing, emery-polishing, and sandblasting.

3. The method of claim 1 further comprising the step of applying ozone to the fabric garment by passing the fabric garment through an ozone machine after the step of raising the temperature to at least ninety degrees Celsius.

4. The method of claim 1 further comprising the step of centrifuging the fabric garment before the step of placing the fabric garment in an industrial dryer, thereby removing any excess humidity.

5. The method of claim 1 wherein the step of humidifying the fabric garment occurs directly inside the industrial dryer.

6. The method of claim 1 further comprising the step of adding small abrasive bodies selected from the group consisting of rubber balls and plastic balls to the industrial dryer prior to operating the industrial dryer.

7. The method of claim 1 further comprising the step of maintaining a constant degree of humidity during the step of operating the industrial dryer.

8. The method of claim 1 further comprising the step of controlling the humidity by introducing a limited quantity of water in the industrial dryer.

9. The method of claim 1 further comprising the step of controlling the humidity by introducing a limited quantity of said mixture of enzyme compounds and water in the industrial dryer.

10. A method for artificially aging textile garments, especially cotton or denim garments, comprising the steps of:

a) preparing a mixture of enzyme compounds and water, the enzyme compounds chosen from the group consisting of Amylase, Cellulase and laccase;

b) humidifying a fabric garment with said mixture;

c) turning the fabric garment inside an industrial dryer capable of controlling its internal temperature for at least forty minutes at an activation temperature of the enzyme compound while keeping a degree of humidity constant;

d) raising the temperature of the machine to at least ninety degrees Celsius for at least ten minutes thereby deactivating the enzyme compounds;

e) rinsing the fabric garment until drosses, and mixture residues are removed; and f) drying the fabric garment;

wherein the step of humidifying a garment is done by spraying said mixture over it.

11. The method of claim 10 further comprising the step of preparing the fabric garment by an action selected from the group consisting of manual abrasion, mechanical abrasion, laser abrasion, sandpapering, wearing, emery-polishing, and sandblasting prior to humidifying the fabric garment by spraying the mixture.

12. The method of claim 10 further comprising the step of applying ozone to the fabric garment by passing the fabric garment through an ozone machine after the step of raising the temperature of the machine to at least ninety degrees Celsius.

13. The method of claim 10 further comprising the step of centrifuging the fabric garment before the step of turning the fabric garment in an industrial dryer, thereby removing any excess humidity.

14. A method for artificially aging textile garments, especially cotton or denim garments, comprising the steps of:

a) spraying a mixture of enzyme compound and water on a fabric garment until the fabric garment is humidified in an industrial dryer and turning the fabric garment for at least forty minutes at an activation temperature of the enzyme compound;

b) raising the temperature of the industrial dryer up to at least ninety degrees Celsius for at least ten minutes thereby deactivating the enzyme compound;

c) rinsing the fabric garment until drosses, enzyme compound, and surfactant residues are removed from the fabric garment; and d) drying the fabric garment.

15. The method of claim 14 further comprising the step of preparing the fabric garment prior to the step of spraying the fabric garment by an action selected from the group consisting of manual abrasion, mechanical abrasion, laser abrasion, sandpapering, wearing, emery-polishing, and sandblasting.

16. The method of claim 14 further comprising the steps of ozone cleaning and bleaching the fabric garment by passing the fabric garment through an ozone machine after the step of raising the temperature to at least ninety degrees Celsius.

17. The method of claim 14 further comprising the step of adding small abrasive bodies selected from the group consisting of rubber balls and plastic balls to the industrial dryer prior to operating the industrial dryer.

18. The method of claim 14 further comprising the step of maintaining a constant degree of humidity in the industrial dryer.

19. The method of claim 14 further comprising the step of controlling the humidity by introducing a limited quantity of water in the industrial dryer.

20. The method of claim 14 further comprising the step of controlling the humidity by introducing a limited quantity of said mixture of enzyme compounds and water in the industrial dryer.

* * * * *